US007678234B2

(12) United States Patent
Haiko et al.

(10) Patent No.: US 7,678,234 B2
(45) Date of Patent: Mar. 16, 2010

(54) DEWATERING ARRANGEMENT ON THE PRESS SECTION OF A WEB-FORMING MACHINE

(75) Inventors: Risto Haiko, Jyväskylä (FI); Erkki Hietamäki, Laukaa (FI); Mikko Kauppinen, Hankasalmi (FI); Reijo Koivuranta, Vesanka (FI); Kauno Kujala, Jyväskylä (FI); Pekka Petrilä, Jyväskylä (FI); Timo Pirinen, Palokka (FI); Esa Rajala, Jyväskylä (FI); Markku Salo, Laukaa (FI); Sampo Vörgren, Muurame (FI)

(73) Assignee: Metso Paper, Inc., Helsinki (FI)

( * ) Notice: Subject to any disclaimer, the term of this patent is extended or adjusted under 35 U.S.C. 154(b) by 771 days.

(21) Appl. No.: 11/550,656

(22) Filed: Oct. 18, 2006

(65) Prior Publication Data

US 2007/0089848 A1 Apr. 26, 2007

(30) Foreign Application Priority Data

Oct. 24, 2005 (FI) ..... 20055570

(51) Int. Cl.
*D21F 1/50* (2006.01)
*D21F 3/10* (2006.01)

(52) U.S. Cl. ..... 162/363; 162/264; 162/335

(58) Field of Classification Search ..... 162/190, 162/199, 264, 272, 281, 282, 335, 363
See application file for complete search history.

(56) References Cited

U.S. PATENT DOCUMENTS 3,057,402 A * 10/1962 Webster ..... 162/368
3,468,242 A * 9/1969 Schaffrath ..... 100/121
4,209,360 A * 6/1980 Stenberg et al. ..... 162/203
4,909,903 A 3/1990 Müllner
5,573,644 A * 11/1996 Poikolainen et al. ..... 162/278
5,580,424 A * 12/1996 Snellman ..... 162/371
5,810,974 A * 9/1998 Laapotti ..... 162/358.5
6,358,370 B1 * 3/2002 Huttunen ..... 162/363
6,461,478 B1 * 10/2002 Meschenmoser ..... 162/205

FOREIGN PATENT DOCUMENTS

DE 3123131 A1 12/1982
DE 19939893 A1 3/2001
FI 880723 A 9/1988
FI 80088 B 12/1989
JP 2004-84122 A 3/2004

OTHER PUBLICATIONS

English Abstract of JP2004084122, 2004.
English Abstract of DE19939893, 2001.
English Abstract of DE3123131 (corresponds to FI830149/FI80088), 1983.
Search Report issued in foreign priority application FI20055570, May 2006.

* cited by examiner

*Primary Examiner*—Steven P Griffin
*Assistant Examiner*—Anthony J Calandra
(74) *Attorney, Agent, or Firm*—Stiennon & Stiennon

(57) ABSTRACT

A dewatering arrangement in the press section of a web-forming machine having a press suction roll (10) and a press fabric (13) arranged to run via the press suction roll (10). The dewatering arrangement has a saveall (15), which is installed in conjunction with the press suction roll (10), and drainage facilities (18) for removing the collected water from the saveall (15). The saveall (15) has a concave guide surface (19) which in the cross direction is located on a partial distance of the circumference of the press suction roll (10) and at a distance from the surface of the press suction roll (10) in order to accomplish a vacuum effect and to hence remove water from the press suction roll (10).

8 Claims, 4 Drawing Sheets

DEWATERING ARRANGEMENT ON THE PRESS SECTION OF A WEB-FORMING MACHINE

CROSS REFERENCES TO RELATED APPLICATIONS

This application claims priority on Finnish App. No. 20055570, filed Oct. 24, 2005, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention concerns a dewatering arrangement in the press section of a web-forming machine of the type having a press suction roll which is arranged to form a press nip with another roll in the web-forming machine, and a press fabric which is arranged to run via the press suction roll, and having a dewatering saveall extending essentially over the entire width of the web-forming machine. The saveall being installed in an area between an opening gap and a closing gap defined by the press suction roll and the press fabric, and having drainage facilities for removing the collected water from the saveall.

In a web-forming machine, the press suction roll serves two main purposes. In addition to dewatering taking place in the press nip, the press suction roll controls the travel of the web on the press section. However, the shell of the press suction roll is open, and a vacuum effect is only exerted on a part of the circumference of the shell in order to establish a vacuum zone. The bores and grooves on the shell hence contain much water after the suction zone, and this water is ejected to the environment of the press suction roll after the press nip for example by centrifugal force. Water removal is only partial, and some water still remains in the bores of the shell and returns to the press nip. This impairs the dewatering ability of the press section and disturbs pressing.

In order to prevent the spreading of water and to remove water from the press suction roll, web-forming machines usually have a dewatering arrangement which contains a saveall. The saveall follows the shape of the press suction roll and extends over a part of the length of the circumference of the shell. The saveall is also often provided with ventilation, which aims to create a vacuum in the saveall. In practice, water released from the surface of the shell is ejected against the walls of the saveall and descends to the bottom part of the saveall and finally runs out of the press section via a discharge connection. The saveall can also be provided with doctoring equipment which doctors water from the surface of the shell into the saveall. Despite ventilation, washing showers and doctoring, some water still remains in the bores of the press suction roll, and the water, in turn, contains fibers and impurities. Furthermore, a vacuum remains inside the press suction roll even after the press nip, and the vacuum partially prevents the removal of water from the bores. Fibers and impurities hence gradually accumulate on the walls of the bores, finally clogging the bores entirely. The fouling of the press suction roll impairs the dewatering ability of the press section, complicates web control and usually leads to a premature replacement of the press suction roll for service purposes.

Savealls of known type have a flat and open structure, and they also have many types of reinforcements to accomplish sufficient rigidity. Especially internal reinforcements inside savealls form corners and pockets which disturb and decelerate the flow rate of water-containing air inside the saveall. A washing shower pipe used in known solutions, installed in conjunction with the press suction roll, also has the same effect. Furthermore, the flow inside the saveall is turbulent. Impurities and fibers contained in water-containing air hence accumulate on the inner surfaces of the saveall, on the top surface of the washing shower pipe and in the above-mentioned corners and pockets. In this way, the saveall becomes gradually dirty, and if the dirt accumulations become loose, they cause quality deviations and even web breaks in production. The press section fabrics and roll coatings may also be damaged.

The saveall covers the circumference of the shell only partially so that some water mist spreads to the environment of the press suction roll. Furthermore, there are uncontrolled circulating air flows, which contain much water mist and steam, in the opening gap formed by the press fabric and the press suction roll after the press nip. The impurities contained in the air flows escaping from the saveall also become attached onto other rolls and the frame structures of the press section. In this way, for example access bridges become slippery and favorable conditions are created for bacterial growth. In order to avoid accidents and production interruptions, both the saveall and its environment require regular cleaning, which calls for a shutdown because of washing.

SUMMARY OF THE INVENTION

The object of the present invention is to accomplish a new type of dewatering arrangement on the press section of a web-forming machine, with the arrangement being more efficient than before and avoiding the drawbacks of known solutions. The characteristic features of the present invention will be more fully understood from the enclosed patent claims. The dewatering arrangement according to the present invention comprises a new type of saveall, the structure and operating principle of which are different from known solutions. In addition to improved protection, the saveall can remove an increasing portion of the water that remains on the press suction roll. At the same time, the press suction roll and its environment remain clean, which reduces considerably the need for shutdowns due to washing. The saveall according to the invention can be installed in confined locations, and the maintenance of the dewatering arrangement is easier than before. The water collection capacity of the saveall can also be adjusted so that the operation of the press section of the web-forming machine can be adjusted optimally. Furthermore, the fouling of the press section and resulting problems and production shutdowns are avoided.

In the following, the invention is described in more detail with reference to the accompanying drawings describing some applications of the invention.

DESCRIPTION OF THE PREFERRED EMBODIMENTS

Figure 1:
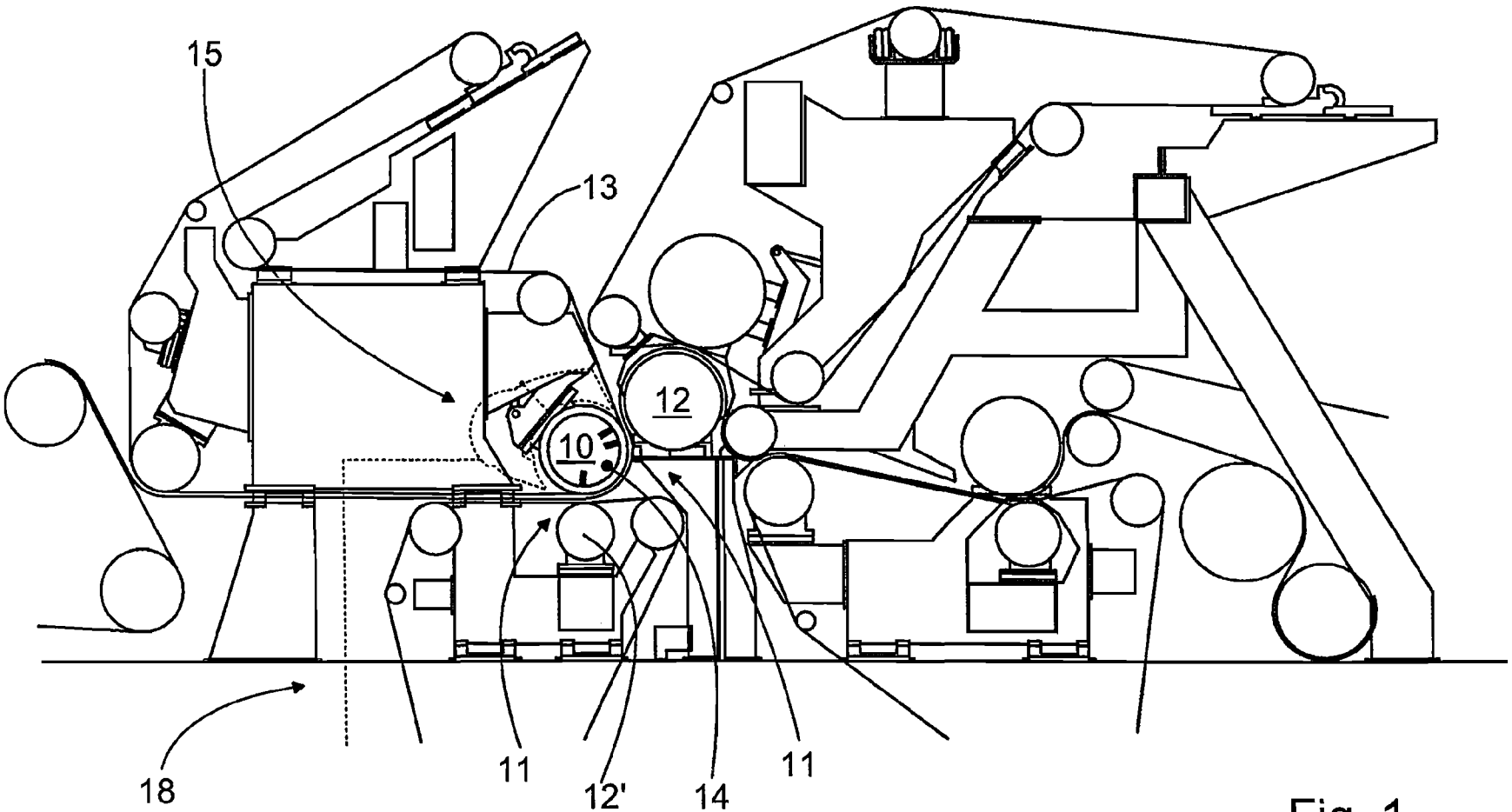
FIG. 1 shows the dewatering arrangement according to the invention on the press section of a web-forming machine.

FIG. 1 illustrates an ordinary press section of a web-forming machine, where water is removed from the web on the press section. For example paper and board machines are web-forming machines. The structure of the press section varies in different applications, but it comprises at least one press nip in order to press the web formed on the web-forming machine. During pressing, the web is supported by means of a press fabric which runs via the press nip, with water being absorbed into the press fabric.

The problems with known solutions are especially related to the press suction roll used for controlling the web. Firstly, the press suction roll 10 forms a press nip 11 with another roll 12 included in the web-forming machine. In the application of FIG. 1, the press suction roll 10 forms a press nip 11 with two rolls 12 and 12'. Furthermore, the press fabric 13 has been arranged to run via the press suction roll 10. The press fabric 13 is usually a press felt which revolves as an endless loop supported by guide rolls. The press suction roll 10 also contains a vacuum zone 14, and a vacuum effect created in this zone keeps the web in contact with the surface of the press fabric 13. At the same time, water travels from the press fabric into the press suction roll through the bores on the press suction roll. In FIG. 1, the vacuum zone 14 is located between the seals. Water in the bores after the press nip and vacuum zone is ejected outwards by centrifugal force. A special dewatering arrangement is used on the press section to collect this water and to prevent it from spreading to the environment.

Figure 2A:
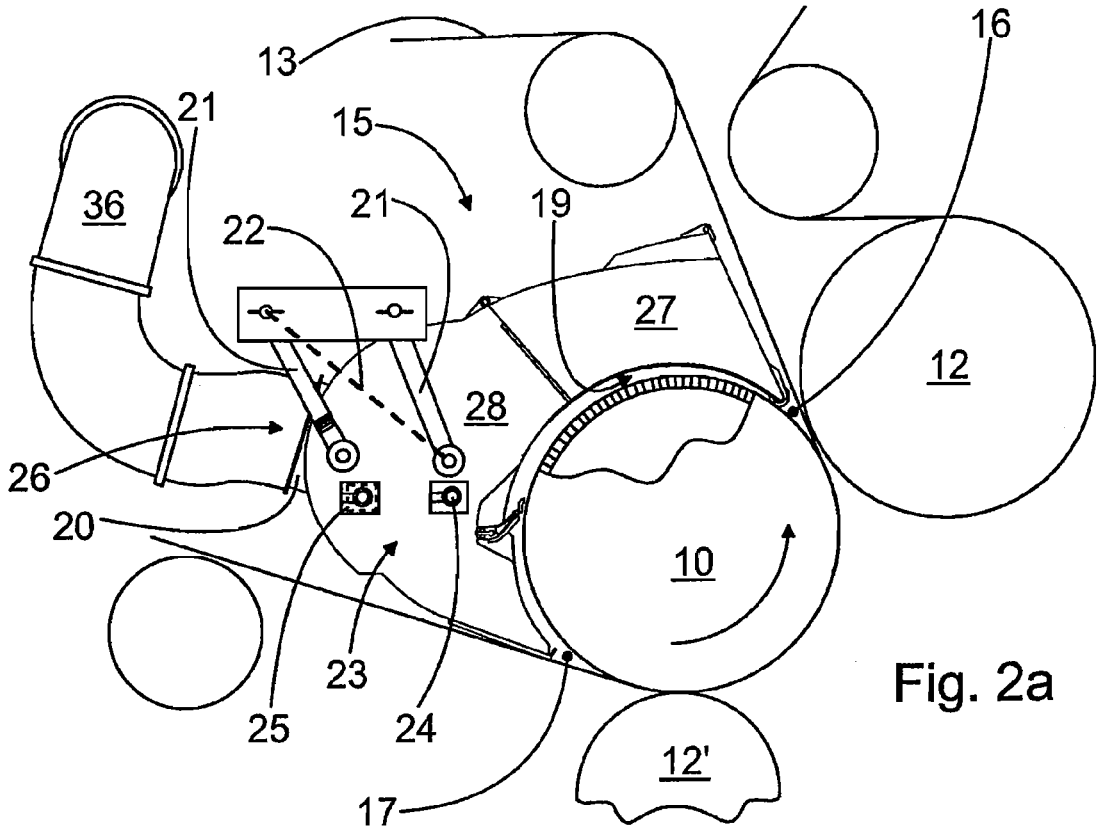
FIG. 2*a* shows the dewatering arrangement according to the invention in the operating position.

The dewatering arrangement comprises a saveall 15 which extends essentially over the entire width of the web-forming machine. As shown in FIG. 2*a*, the saveall 15 is installed in the area between the opening gap 16 and closing gap 17 limited by the press suction roll 10 and the press fabric 13. Furthermore, the dewatering arrangement comprises drainage facilities 18 for removing the collected water from the saveall 15. In FIG. 1, the saveall 15 according to the invention as well as the drainage connected to it are described by broken lines. As shown in FIG. 2*a*, according to the invention, the saveall 15 has a concave guide surface 19 which in the cross direction is located on a partial distance of the circumference of the press suction roll 10 and at a distance from the surface of the press suction roll 10. A vacuum is hence created between the guide surface and the shell of the press suction roll as the suction roll revolves, and water is removed from the suction press roll by the vacuum. In other words, the vacuum effect removes water from the holes, grooves and bores on the outer surface of the shell. Fibers and impurities are also removed with the water. The press suction roll hence remains clean for a long period of time, which improves the efficiency of the press section and reduces the need for service. The washing shower pipe used in known solutions can also be omitted, which simplifies the structure of the dewatering arrangement and stabilizes the flow of water-containing air in the saveall. In practice, the shell of the press suction roll is washed internally by means of a washing shower (not illustrated). The vacuum created by the guide surface absorbs this washing water through the bores, which prevents the bores from clogging. In other words, shutdowns caused earlier by washing to unclog the bores can often be avoided completely.

In addition to a new and surprising operating principle, the structure of the saveall differs from the known structure. According to the invention, the saveall 15 extends from the opening gap 16 to the closing gap 17. The escaping of water and gases from the saveall is hence prevented, which reduces the fouling of the environment of the press section. In general, the saveall extends from the closing gap below at least up to the top dead center of the press suction roll, but preferably the saveall extends from one gap to the other as illustrated in the application of FIG. 2*a*. In order to accomplish a vacuum effect, the guide surface must be located sufficiently close to the press suction roll. According to the invention, the distance of the guide surface from the surface of the press suction roll is 5-30 mm, preferably 10-25 mm. Furthermore, the guide surface is arranged so that the said distance increases in the direction of rotation of the press suction roll. A type of an opening gap is hence formed, with the gap forming a vacuum over the entire length of the press suction roll when the press suction roll revolves. Moreover, by arranging sufficient replacement air into the press suction roll by means of ventilation, the pressure inside the shell can stabilize outwards, simultaneously drawing water from the bores on the shell. The water removed from the bores is ejected into the saveall, from where the water is removed in a controlled manner and led back to the process. The drainage facilities 18 can also include a ventilation connection 20 by means of which a vacuum is created in the saveall 15. The operation of the ventilation connection is described in more detail below.

Savealls of known type are stationary and they have been placed at a distance from the press suction roll. According to the invention, the saveall is now supported only at its ends to the web-forming machine. Furthermore, the support is carried out by means of support arms 21 so that the saveall 15 can be moved from the operating position to the service position and vice versa. By moving the saveall, there is hence sufficient space for washing and other service even in a confined location. Moreover, for example the press suction roll can be removed without disassembling the dewatering arrangement in other respects, which speeds up service further.

Figure 2B:
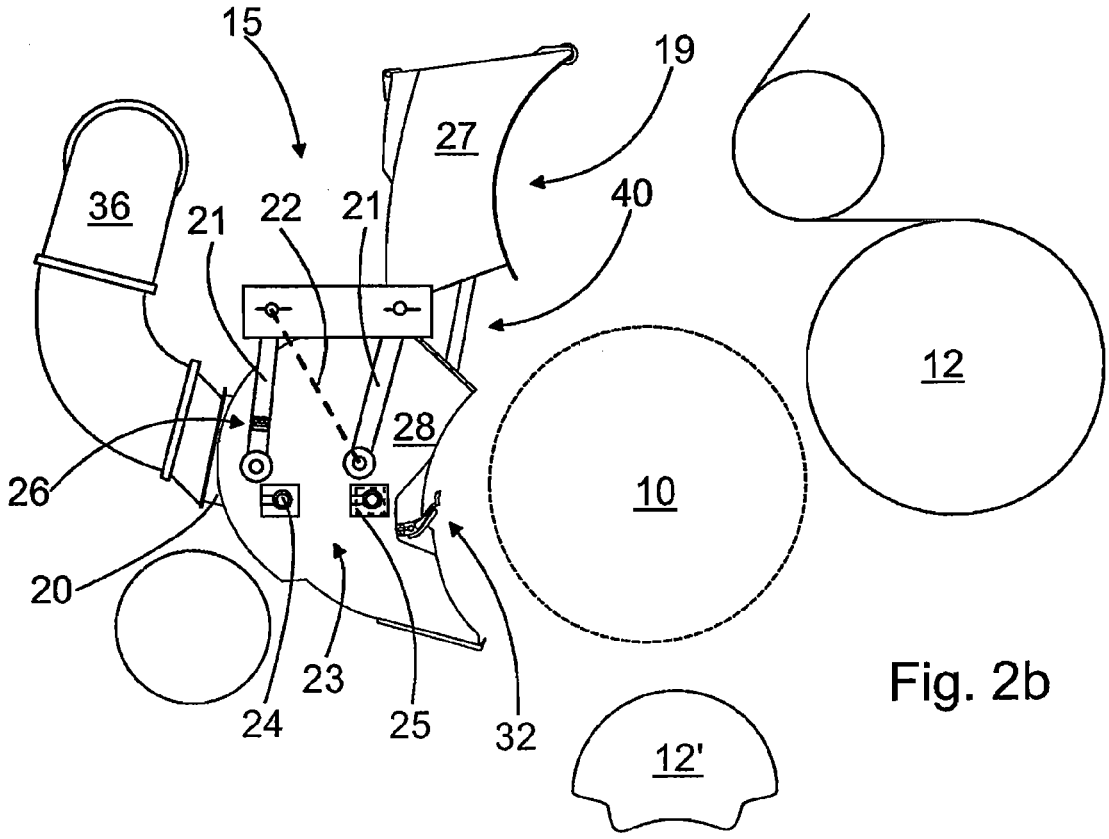
FIG. 2*b* shows the dewatering arrangement according to the invention in the service position.

In the application of FIGS. 2*a* and 2*b*, there are two support arms 21 at each end of the saveall 15, with the support arms 21 installed so that the saveall 15 hangs in a way. This type of structure is stable, and it is easy to move the saveall. An actuator 22, such as a hydraulic cylinder, is preferably used for moving the saveall 15. The actuator 22 is illustrated with the broken line in FIGS. 2*a* and 2*b*. The actuator 22 is only intended for moving the saveall, because according to the invention, locking devices 23 are installed between the saveall 15 and the web-forming machine to lock the saveall 15 both to the operating position and service position. Unintentional movements of the saveall can hence be avoided, and the actuator can be dimensioned on the basis of the force required by moving alone. Without the locking devices, the actuator would make up a functional spring so that the dewatering equipment would become a system which vibrates in a dynamic environment. This can be avoided by means of rigid locking, and the guide surface remains at a desired distance from the press suction roll irrespective of changes in the operating conditions.

In the application presented, there are two slots 24 included in the locking devices 23 at each end of the saveall 15, and a locking pin corresponding to the slot is installed in the frame of the press section. The location of the support structure 25 of the locking pin is illustrated with the rectangle drawn with a broken line in FIGS. 2*a* and 2*b*. The locking pin is preferably spring-loaded, and it is retracted for example by means of a pneumatic cylinder. In other words, when pressure is released, the locking pin returns to the locking position and stays there. Furthermore, suitable sensors can be used for detecting the position of the saveall so that the locking can be ensured. Sensor data can also be used for controlling the actuator when moving the saveall. It is hence also possible to detect the unintentional moving of the saveall, which gives reason for the conclusion that something is wrong. In this case, the situation can be checked quickly and damage to the press section and other structures can be avoided.

The saveall and its support arms are fastened to the frame of the press section as planned. If necessary, the position of the saveall can be adjusted optimally for each application by changing the location of the top ends of the support arms. In other words, this is a rough adjustment carried out when the saveall is mounted. In addition to this, the saveall 15 comprises equipment 26 for adjusting the desired location and position of the saveall 15 with respect to the press suction roll 10 and/or press fabric 13. In the application presented, the length of the rearmost support arms 21 can be changed so that fine adjustment is accomplished. As an example, a telescope structure with threads on the support arm is simple and easy to use. The guide surface and the entire saveall can hence be brought precisely to the desired location and to the correct position. Adjustment is also quick.

A saveall according to the invention, comprising one part and equipped with a guide surface, works as planned. Despite this, the saveall 15 preferably comprises two parts 27 and 28 which are connected to each other by a joint. In other words, the parts can be turned with respect to each other, which facilitates the service of the saveall, among other things. Moreover, according to the invention, the guide surface 19 is in the first part 27 in the direction of rotation of the press suction roll 10. In other words, the guide surface is located as soon as possible after the opening gap so that the vacuum effect created can be utilized as well as possible and so that water has sufficient time to be ejected into the saveall.

Figure 3:
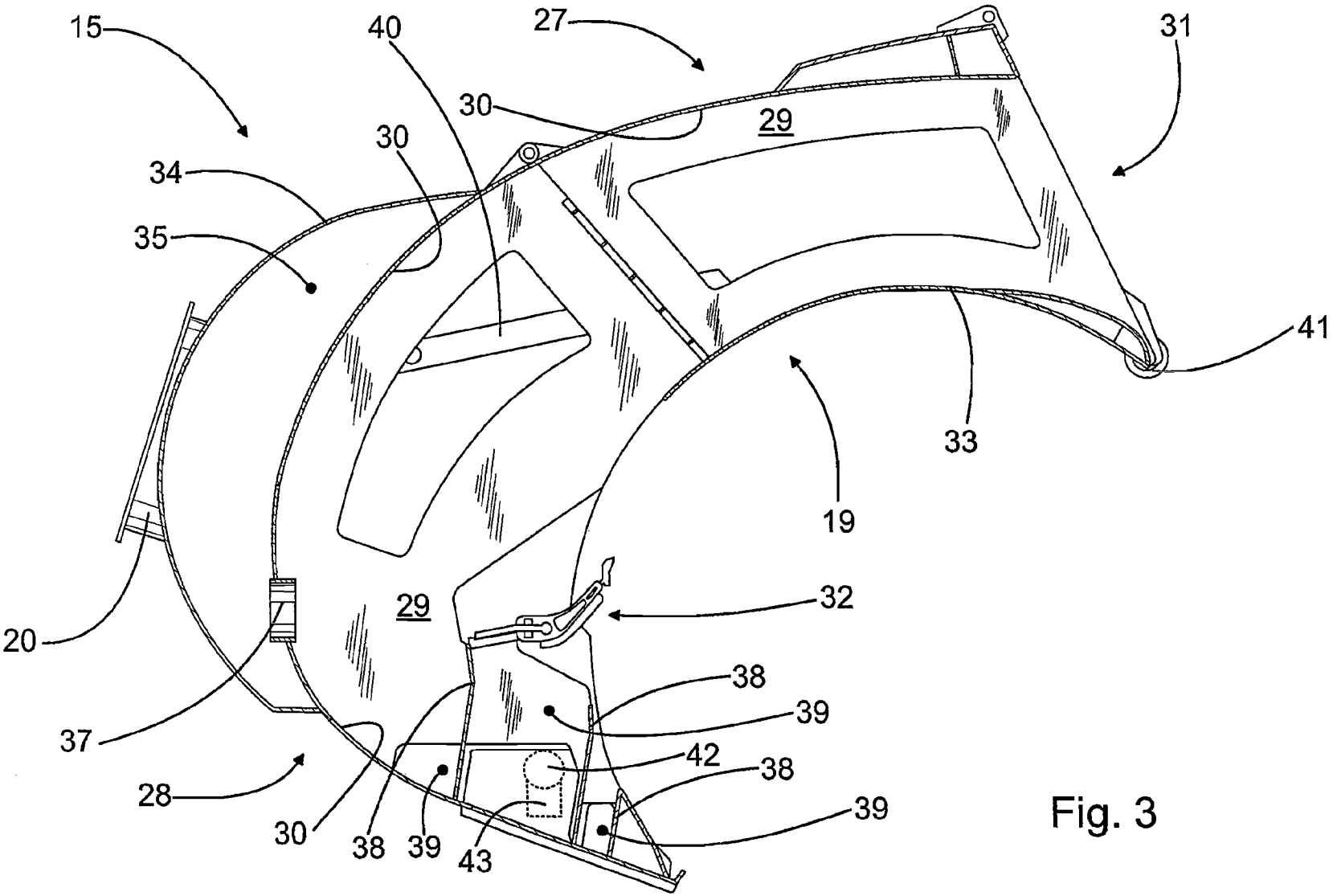
FIG. 3 shows a side view of the saveall included in the dewatering arrangement according to the invention in the operating position.
Figure 4:
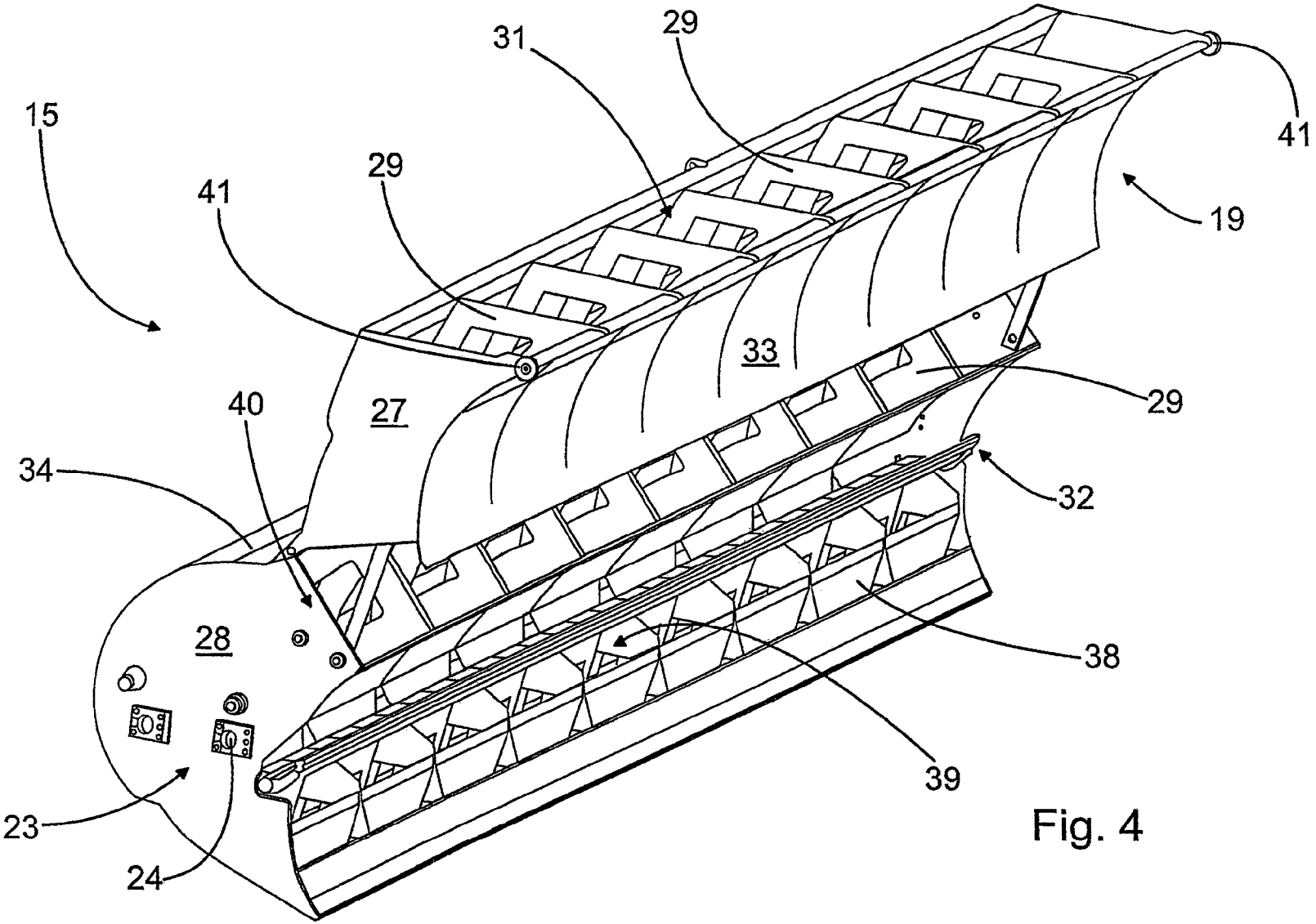
FIG. 4 shows an axonometric view of the saveall included in the dewatering arrangement according to the invention in the service position.

The saveall is preferably made of a plate material from which the desired shapes can be made easily. Furthermore, both parts 27 and 28 have a cellular structure, with the internal reinforcements inside the structure also made of a plate material. As shown in FIG. 4, ribbed structures 29 in cross direction to the saveall are preferably used. The vacuum hence spreads evenly inside the parts without disturbing the flow of water. In fact, the ribbed structures guide the water and gases towards the bottom part of the saveall and simultaneously prevent harmful turbulence. Furthermore, the ribbed structures in the parts are placed so that they are against each other in the operating position. This stiffens the saveall and avoids flow disturbances. The objective in the design of both parts 27 and 28 is also that, as shown in FIG. 3, the internal flow surface 30 of a saveall 15 which is in the operating position is as smooth as possible. Especially the back wall of the saveall is uniform and smooth so that water hitting it turns down in a controlled manner and flows to the bottom of the saveall without obstruction. The saveall hence also stays clean as there are no locations where the water can stand. Due to the structure of the saveall and especially due to its design, the velocity of air flowing from the press fabric and generally from the press nip area remains relatively constant inside the saveall, which prevents dirt from accumulating on the internal surfaces of the saveall.

The cellular structure of the saveall can also be utilized in dewatering. According to the invention, as shown in FIG. 3, the front part 31 of the first part 27 in the direction of rotation of the press suction roll 10 is open in the cross direction of the web-forming machine. Water-containing air hence flows from the opening gap 16, shown in FIG. 2*a*, through the first part 27 to the second part 28, shown in FIG. 3. In practice, some of the water and gases travel with the press fabric despite the guide surface. However, due to the open front part, the vacuum in the saveall extends to the press fabric so that the spreading of water is prevented. This further improves the cleanliness of the environment of the press section. For example an air doctor can also be installed in the top edge of the front part to remove the boundary layer air which travels with the press fabric and to guide this air into the saveall. As shown in FIG. 3, in practice, the dewatering arrangement comprises doctor equipment 32 installed in conjunction with the press suction roll 10, with the doctor equipment 32 located after the guide surface 19 in the direction of rotation of the press suction roll 10. The water removed from the bores and grooves by the vacuum effect can hence be doctored into the saveall 15. This prevents the water from going back into the press nip.

In the application presented, as shown in FIG. 3, the guide surface 19 is made up of a shaped plate 33 which is fastened to the saveall 15. A separate plate can be shaped easily, although the bottom surface of the upper part of the saveall could also serve as a guide surface. The front edge of a separate plate can also be fitted very deep into the opening gap. Furthermore, the plate can be manufactured from a material other than the one used in the saveall, or a different type of surface treatment can be used. The plate also prevents impurities from falling on the press suction roll from above. Moreover, the front edge of the plate is shaped so that the water jet ejected from the press nip tends to follow the top surface of the plate. The ability of the plate to create a vacuum in conjunction with its guide surface and in conjunction with the surface structure of the press suction roll can be adjusted by changing the length and curvature of the plate. The main dimensions naturally depend on the press suction roll used.

The back part of the saveall 15 according to the invention also has a curved stiffener 34 which, together with the flow surface 30, forms a channel 35 over the entire width of the saveall 15. The stiffener 34 also has a ventilation connection 20 which is connected to a ventilation duct 36, as shown in FIGS. 2*a* and 2*b*. According to the invention, the duct 35 is used as a type of a manifold from where the vacuum is distributed into the saveall 15 through several nozzles 37. In practice, one nozzle is installed in each space restricted by two ribbed structures, and the diameter of the nozzle is dimensioned on the basis of the location of the nozzle. In this way, an as even vacuum as possible is achieved over the entire width of the saveall by using just a single ventilation connection. In practice, the smaller the distance of a nozzle from the ventilation connection, the smaller its flow cross-sectional area. In fact, the ventilation connection is situated at one end of the saveall as low as possible. The flow of air hence continues steadily over the entire internal length of the saveall, which ensures that the internal surface of the saveall remains clean. In addition to the top part of the saveall, the vacuum also pulls gases from the closing nip below the saveall. Furthermore, the vacuum zone in the press suction roll is arranged to start before the press fabric. The pressure caused by the closing gap is hence released into the press suction roll, which further prevents the spreading of impurities to the environment of the press section.

In practice, the saveall is made so stiff that it does not get into contact with the press fabric or press suction roll in any situation. The water load and the deflection caused by the mass of the saveall and by the vacuum effect are also taken into account in dimensioning. The bottom part of the saveall 15 contains longitudinal vertical walls 38 which form water channels 39 that prevent the water from flowing back to the press nip. There are several water channels to avoid the harmful wave action of water. The water is led back into the process from the water channels. In the application example, the total volume of the water channels is approximately 225 liters per width meter of the saveall. FIG. 3 also illustrates a suction connection 42 which is here installed in the middle water channel 39. The suction connection 42 also comprises a suction nozzle 43 which is placed so low that it is always below the water level. Dewatering is efficient because only water is hence absorbed. The suction connection is used for example in a saveall with a smaller water volume or in conjunction with a higher water volume or if the saveall needs to be installed so that it leans forward.

When the saveall or the other parts of the press section are serviced, the locking is released and the saveall 15 is moved to the service position shown in FIG. 2*b*. The locking elements 40 installed in conjunction with the first part 27 and the second part 28 are released before moving the saveall 15, see FIG. 4. The mutual position of the parts 27 and 28, which are joined to each other by means of the said locking elements, can be locked in the operating position and service position of the saveall. The edges of the upper part 27 of the saveall are also equipped with rollers 41 which meet the shell of the press suction roll 10 when the saveall 15 is being moved. During operation, the rollers are not in contact with the shell. Finally, the saveall 15 is locked to the service position and the upper part 27 is lifted. The mutual position of the parts 27 and 28 is locked again by means of the locking elements 40 so that all parts are sure to remain in place during service. Moving of the saveall is enabled by the elastic section of the ventilation duct 36. The saveall is moved to the operating position in reverse order.

The guide surface according to the invention accomplishes a significant vacuum effect which absorbs water even from the bores on the shell. The bores and the entire surface of the shell hence remain clean, which prolongs the lifetime of the press suction roll and improves the operating degree of the web-forming machine. Cleaning is further improved by a ventilated press suction roll. In other words, air flows outwards from inside the shell through the bores. The shape of the saveall maintains a flow inside the saveall without protruding parts which would gather dirt. The water ejected from the opening gap can be guided into the saveall in a controlled manner. Furthermore, the ventilation of the saveall provides a good vacuum over the entire area of the saveall so that the escaping of impurities from the saveall is prevented. The vacuum is also distributed evenly, which results in disturbance-free flows so that the internal surfaces of the saveall remain clean. The dewatering capacity of the saveall can be adjusted in many ways so that its operation can be optimized when the operating conditions change. The saveall also has a specific service position, which speeds up washing, among other things. The essential feature is the vacuum effect created by the guide surface so that the press suction roll can be cleaned without external energy.

We claim:

1. A dewatering apparatus in a press section of a web-forming machine which defines a cross machine direction width, the apparatus comprising:

a press suction roll mounted for rotation and having a circumferential surface, the press suction roll engageable with a second roll of the press section to form a press nip; and a press fabric arranged to wrap about a portion of the press suction roll, and to form a closing gap defined between the press suction roll and the press fabric as the press fabric come into engagement with the press suction roll, and to form an opening gap defined between the press suction roll and the press fabric where the press fabric leaves engagement with the press suction roll;

a saveall installed in an area between the opening gap and the closing gap extending essentially over the entire width of the web-forming machine, wherein the saveall has a concave guide surface which extends closely spaced from the circumference of the press suction roll and is arranged to produce a vacuum effect and hence remove water from the press suction roll;

drainage facilities connected in water removing relation to the saveall; and wherein the saveall has a first part connected to a second part by a joint, the first part closer to the opening gap than the second part, and wherein the guide surface is part of the first part.

2. The apparatus of claim 1, wherein the first part and the second part have a cellular structure which is made of a plate material and which contains ribbed structures in the cross machine direction of the saveall.

3. The apparatus of claim 1 wherein the first part and the second part are designed so that an internal flow surface of the saveall is smooth when the saveall is in an operating position.

4. The apparatus of claim 1, wherein a front part of the first part which faces the press fabric is open in the cross machine direction in order to guide air flow from the opening gap though the first part to the second part.

5. The apparatus of claim 1, wherein locking elements are installed between the first part and the second part and arranged to lock the first part with respect to the second part, in an operating position and in a service position.

6. A dewatering apparatus in a press section of a web-forming machine, the web-forming machine having a cross machine direction width, the dewatering apparatus comprising:

a press suction roll mounted for rotation in a first direction and having a circumferential surface, the press suction roll being engaged with a second roll of the press section to form a press nip; and a press fabric forming an endless loop to contain the press suction roll and to wrap about a portion of the press suction roll, and to travel in the first direction, wherein the press fabric forms a closing gap defined between the press suction roll and the press fabric as the press fabric comes into engagement with the press suction roll, and wherein the press fabric forms an opening gap defined between the press suction roll and the press fabric where the press fabric leaves engagement with the press suction roll;

a saveall installed within the press fabric endless loop in an area between the opening gap and the closing gap extending essentially over the entire width of the web-forming machine;

a concave guide surface forming part of the saveall which extends from the opening gap closely spaced from the circumference of the press suction roll and is arranged to produce a vacuum effect to remove water from the press suction roll; and wherein the saveall has a first part hingedly connected to a second part by a joint, the first part being closer to the opening gap than the second part, and wherein the concave guide surface is part of the first part.

7. The apparatus of claim 6, wherein locking elements are installed between the first part and the second part and arranged to lock the first part with respect to the second part, in an operating position and in a service position.

8. The apparatus of claim 6 further comprising doctoring equipment installed between the save all and the press suction roll and positioned after the guide surface in the first direction and before the closing gap so as to doctor water from the circumferential surface into the saveall.

* * * * *